United States Patent [19]

Schaper

[11] 4,331,482

[45] May 25, 1982

[54] CONTINUOUSLY OPERATING CENTRIFUGE

[75] Inventor: Helmut Schaper, Brunswick, Fed. Rep. of Germany

[73] Assignee: Braunschweigische Maschinenbauanstalt, Brunswick, Fed. Rep. of Germany

[21] Appl. No.: 181,852

[22] Filed: Aug. 27, 1980

[30] Foreign Application Priority Data

Sep. 11, 1979 [DE] Fed. Rep. of Germany ..... 2936659

[51] Int. Cl.[3] ..... B04B 5/00; B04B 11/00

[52] U.S. Cl. ..... 127/19; 210/377; 210/380.1; 233/45

[58] Field of Search ..... 127/19; 233/34, 45, 233/28; 210/380.1, 377, 371, 360.2, 297

[56] References Cited

U.S. PATENT DOCUMENTS

| | | | |
|---|---|---|---|
| 2,685,370 | 8/1954 | Ruegg | 210/377 X |
| 3,250,391 | 5/1966 | Pause | 210/380.1 X |
| 3,805,956 | 4/1974 | Mercier | 127/19 X |
| 3,837,913 | 9/1974 | Hillebrand et al. | 127/19 |
| 3,989,185 | 11/1976 | Mercier | 233/34 X |
| 4,014,497 | 3/1977 | Spiewok et al. | 210/380.1 X |
| 4,204,964 | 5/1980 | Cailliot | 210/380.1 X |

FOREIGN PATENT DOCUMENTS

| | | | |
|---|---|---|---|
| 2749285 | 5/1979 | Fed. Rep. of Germany | 127/19 |

OTHER PUBLICATIONS

Honig; Principles of Sugar Technology; 1963; Elsevier Publishing Co., New York; pp. 344, 345, 335.

*Primary Examiner*—Kenneth M. Schor
*Attorney, Agent, or Firm*—W. G. Fasse; D. H. Kane, Jr.

[57] ABSTRACT

The present continuously operating centrifuge produces sugar of uniformly high quality from low grade sugar massecuite of uneven consistency by distributing the massecuite to differing selected levels of a centrifugal screening basket. The distribution level depends on the liquid content characteristics of the massecuite. An accelerating cup is mounted for rotation centrally within the basket for receiving and delivering massecuite to a distributing bell opening downwardly and surrounding the accelerating cup. The distributing bell directs the massecuite toward the tapering wall of the centrifugal screening basket. The lower edge of the distributing bell is vertically adjustable relative to a lower zone of the screening basket for said distributing of the massecuite to different levels of the basket. The centrifugal basket may have several zones. The lower edge of the distributing bell is adjustable relative to a lower zone of the basket from which the area of aperture openings decreases in the upward direction. Adjustment of the vertical position of the distributing bell may be automatically controlled in response to the characteristics of the sugar passing over the upper edge of the centrifugal basket.

18 Claims, 7 Drawing Figures

31
32
30
29
27
26
28
19
15

CONTINUOUSLY OPERATING CENTRIFUGE

CROSS REFERENCES TO RELATED APPLICATIONS

Applicant claims under 35 U.S.C. 119 for this patent application the convention priority of German Patent application No. P 29 36 659.4; filed on Sept. 11, 1979 in the Federal Republic of Germany.

BACKGROUND OF THE INVENTION

The present invention relates to sugar centrifugals preferably for the continuous separation of low-viscosity, low-grade sugar massecuites into sugar and runoff. Such centrifugals are generally equipped with a conically shaped basket tapering outwardly in an upward direction and rotating about a vertical axis, with a massecuite distributing device comprising a rotating accelerating cup and a rotating massecuite distributing bell tapering outwardly in a downward direction over the cup. In the sugar industry, it is a basic aim to produce as much sugar as possible from sugar beets and/or from sugar cane. Achieving this aim, however, is not always possible, because, for example, the consistencies of the massecuites to be centrifuged vary considerably. Such variations are most evident when low-grade massecuite is being centrifuged. Hitherto, sugar factories have been compelled to adapt their massecuites to the centrifugals, particularly where low-viscosity, low-grade massecuites are produced, depending on the process applied, in order to obtain a good quality after product sugar having uniform crystals.

Continuously operating centrifugals in which low-grade massecuites may also be centrifuged and in which a distributing bell is incorporated are known. According to U.S. Pat. No. 3,837,913 corresponding to German patent publication No. 2,207,663, the distributing bell has the task of transferring the massecuite as uniformly as possible to the basket so as to ensure a smooth run of the centrifugal. A continuously operating centrifugal operates efficiently only if massecuites having a substantially uniform consistency are being centrifuged. Massecuites having a low liquid content reduce the throughput efficiency due to the poor distribution on the screen of the centrifugal basket. The sugar produced from low viscosity massecuites may have a poor quality although the throughput remains the same, since the high syrup liquid content makes the massecuite slide too rapidly over the working screen without the whole of the runoff being extracted. To prevent this, the throughput must be reduced.

According to German utility model application No. 1,782,182, the main dewatering of the massecuite is to take place through the bottommost screen zone. In this respect the statements made in connection with DE-AS No. 2,207,663, (U.S. Pat. No. 3,837,913) apply, i.e., too large a quantity of runoff is separated in the case of high viscosity massecuites, with the result that the massecuite distribution on the working screen of the basket is not uniform, whereby an uneven run of the centrifugal results so that the throughput must be reduced until the centrifugal runs smoothly again. On the other hand, if the massecuite is of low viscosity, the dewatering will be insufficient. The quality of the produced sugar is poor and the throughput must practically be reduced.

OBJECTS OF THE INVENTION

In view of the above it is the aim of the invention to achieve the following objects singly or in combination:

- to influence the consistency of the massecuite supplied onto the screen basket in such a way that the screen is receiving at its various levels continuously a massecuite of substantially constant consistency;
- to provide continuously operating centrifugals in which low grade massecuite of varying consistency and viscosity may be processed to a uniform result;
- to afford substantially the same rate of processing and throughput for massecuite of low as well as high liquid content in continuously operating centrifugals;
- to eliminate the necessity of separately preparing the massecuite to uniform consistency before handling by the centrifuge;
- to provide sugar centrifugals which are automatically adjustable in response to the varying results obtained from massecuite of uneven quality;
- to assure production of sugar of uniformly high quality from low grade sugar massecuite even when the consistency or viscosity, that is, the liquid content of the massecuite, varies extensively at the input to the centrifuge; and
- to provide a sensitive preliminary water removal from the massecuite prior to its coming into contact with the main zone of the screening basket.

SUMMARY OF THE INVENTION

According to the invention, preferably the lower edge of the massecuite distributing bell of a massecuite feeding device is vertically adjustable. Thus, sufficient runoff is removed from a low-grade massecuite of variable consistency, preferably a low-viscosity massecuite through a known transfer section equipped with screens and inclined to the vertical axis of the screen basket. The runoff removal is sufficient so that the massecuite layer forming at the inlet section of the screen basket is of uniform thickness and can be separated into molasses and sugar to an optimum extent.

If the massecuite contains a comparably small amount of liquid, the lower edge of the massecuite distributing bell is moved upwardly so that the massecuite is available in an upper area of the transfer section equipped with screens. Thus, the lower areas of the transfer section cannot act as a liquid-removing means and the massecuite retains more liquid. On the other hand, if the massecuites have a comparably low viscosity and hence contain much liquid the lower edge of the distributing bell is moved downwardly. Thus, the transfer zone on the transfer section of the screen basket is moved downwardly and the massecuite must cover a longer distance equipped with screens, whereby it is dewatered to a larger extent. Thus, the vertical adjustment of preferably the lower edge of the distributing bell enables a sensitive predewatering so that a massecuite of optimum consistency is transferred to the basket.

The slidability of preferably the lower edge of the massecuite distributing bell may be achieved in that the entire massecuite distributing bell or a part of the bell is guided, for example, by pins slidable lockable, and adjustable in respective slots.

The optimum separation of sugar and runoff is enhanced by the construction of the screens in the transfer section which is formed by the lower end of the screen basket. The screens of the transfer section are provided with passage holes decreasing in size from the bottom to the top and having an upperforated zone at the upper edge before the transition to the centrifuging zone of the basket.

The adjustment of the lower edge of the distributing bell may be accomplished by control elements and control loops in response to sensing the quality of the fed massecuite and/or the quality or, respectively, quantity of the produced sugar which is supplied over the upper edge of the basket into the sugar collecting compartment.

BRIEF FIGURE DESCRIPTION

In order that the invention may be clearly understood, it will now be described by way of example, with reference to the accompanying drawings, wherein.

DETAILED DESCRIPTION OF PREFERRED EXAMPLE EMBODIMENTS AND OF THE BEST MODE OF THE INVENTION

Figure 1:
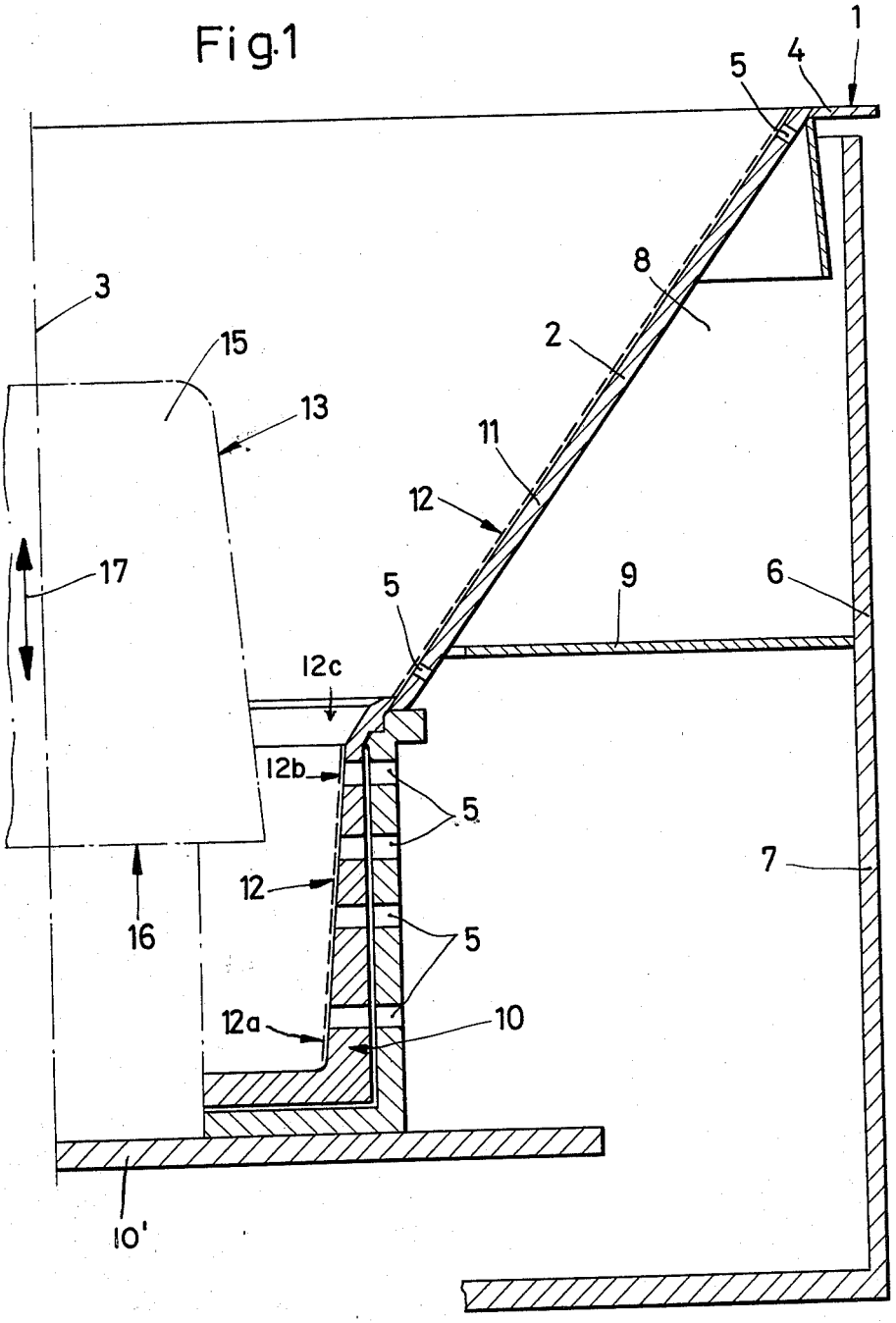
FIG. 1 is a schematic sectional view along the rotational axis of a centrifugal embodying this invention.

FIG. 1 shows the nature of the invention and symbolizes the idea underlying all possible alternative structural embodiments.

In a continuously operating centrifugal 1 shown but partially, a centrifugal basket 2 flaring in an upward direction and having the form of a truncated cone which is rotatable about a vertical axis 3, is equipped with a separating screen symbolically shown by a dashed line 12. The basket and screen separate sugar massecuites into sugar and runoff.

While the crystalline sugar retained by the separating screen 12 travels in the direction toward the upper end of the centrifugal basket 2 and leaves the basket over a discharge edge 4, the runoff passes through the separating screen 12 and leaves the centrifugal basket 2 through corresponding discharge openings 5.

On the outside, the centrifugal basket 2 is surrounded by a liquid collecting housing 6 which has a lower liquid collecting compartment 7 for green syrup and an upper liquid collecting compartment 8 for high green or white syrup. Both liquid collecting compartments 7 and 8 are partitioned by a stationary separating wall 9.

At its lower end the centrifugal basket 2 has a basket zone (portion) 10 which, compared to the upper basket zone 11, is substantially more inclined relative to the vertical rotational axis 3. Both basket zones 10 and 11 are mounted on first mounting means such as a platform 10' for rotation by a drive shaft not shown.

The interior of both basket zones 10 and 11 is also equipped with said screens 12. Further, the lower basket zone 10 is provided with substantially more discharge openings 5 in its surface area than the upper basket zone 11 relative to its surface area. The separating wall 9 is arranged at such a level that the lower discharge openings 5 of the upper basket zone 11 are within the area of the lower liquid collecting compartment 7 for green syrup. The upper basket zone 11 has only two circumferential rows of discharge openings 5, one row is located at the lower and the other row is located at the upper end of the upper basket zone 11 as shown in FIG. 1.

The separating screen 12 of the lower basket zone 10 has a lower area **12*a* which allows a very large liquid throughput because it has a large aperture density. This may, for example, be achieved by a large number of apertures, whereby said aperture density is defined as the ratio of open to closed screen area. In a middle area 12*b* the possible liquid throughput is smaller because this area has an intermediate aperture density, while an at least narrow upper area 12*c* does not allow a liquid passage at all since it is not provided with apertures. The decreasing aperture density from the zone 12*a* to the zone 12*c* is shown in FIG. 1 by the spaces between the dashes representing the screen 12**. These spaces get shorter from the bottom up.

The construction of the screen 12 offers many possibilities of dividing a screen into a plurality of zones or areas wherein the number of apertures per unit area decreases from one zone to the next in a fine gradation, or into just a few zones wherein the number of holes per unit area decreases from one zone to the next in a coarse gradation. Screens 12 having a linear or progressive gradation may also be provided.

For the feeding of the massecuite into the centrifugal basket 2 a massecuite feeding device 13 is used, which has at least an accelerating cup 14 (FIG. 2) as well as an accelerating and distributing bell 15 flaring in a downward direction in the form of a truncated cone and extending, with its bottom edge 16, inside the lower basket zone 10. Second mounting means, such as the bottom 14' of the cup 14 serve for securing the cup 14 to the top of a drive shaft not shown, so that the cup 14 may rotate with the drive shaft. Third mounting means, such as the elements 19, 20, 21, 22 to be described in more detail below, secure the bell 15 to the cup 14 in an adjustable manner and for rotation with the cup.

According to the invention, the accelerating and distributing bell 15 or its bottom edge 16, or an equivalent structural part is movable in the direction of the double arrow 17 in FIG. 1 so that it can take up various positions (see FIG. 2) at different vertical levels.

Figure 2:
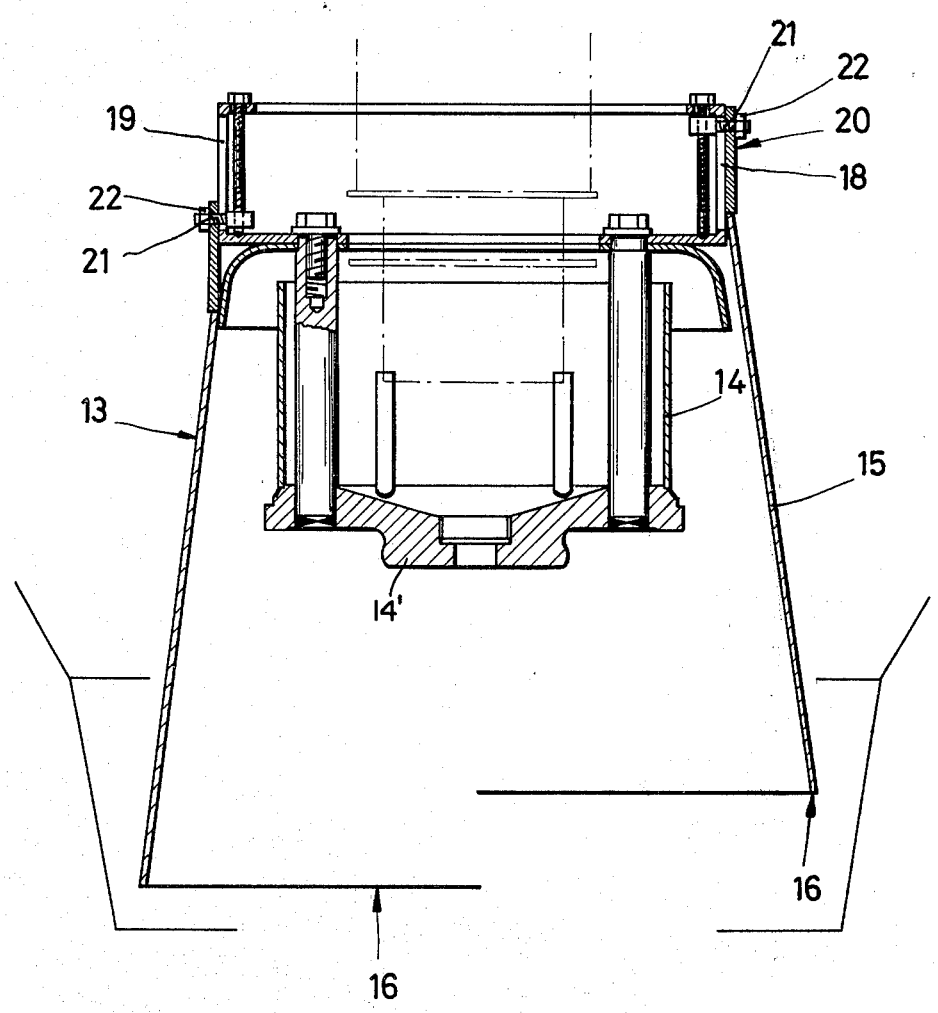
FIG. 2 shows an especially simple structural embodiment of the centrifugal in accordance with the invention in a partial sectional view.

When the massecuite is fed while the accelerating bell 15 takes up a lowered position relative to the cup 14 and relative to the basket zone 10 as shown in the left-hand side of FIG. 2, it must travel over a comparably long distance on the screen 12 of the lower basket zone 10 before it reaches the upper basket zone 11. According to the invention, the accelerating bell 15 is adjusted to such a level that the green syrup, which must be left in the massecuite to maintain the flowability of the massecuite for its passage from the lower basket zone 10 into the upper basket zone 11 can flow through the lower row of holes 5 in the upper zone 11. Thus, such quantity of green syrup flows off into the lower liquid collecting compartment 7 for green syrup. By proper vertical adjustment of the accelerating bell 15 it is possible to ensure that very large amounts of green syrup are separated in the lower basket zone 10 to such an extent that only remainders flow off through the lower discharge openings 5 of the upper basket zone 11. According to the invention, the correct adjustment of the accelerating bell 15 makes sure that, irrespective of an extremely wide range of the liquid content of the fed massecuite, always a massecuite or intermediate product having a constant solid to liquid ratio is supplied to the upper basket zone 11 whereby an optimum throughput and separating efficiency in this basket section is achieved.

According to the invention the vertical adjustment of the accelerating and distributing bell 15 may be embodied in various structural ways.

The drawings show examples of the vertical adjustment of the entire accelerating bell 15. However, the idea underlying the invention may be accomplished even if the accelerating bell 15 itself remains stationary and, instead, movable slides, rings, masks or the like are vertically adjustable to extend or retract the lower edge 16 at least functionally. It may also be possible, by means of suitable links, to shift the screen portion 12 of the lower basket zone 10 up or down so that the massecuite strikes the lower screen portions at different effective levels after having passed over the lower edge 16 of accelerating bell 15. In other words, the bell 15 may remain stationary and the lower portion of the screen is shifted up or down as indicated by the arrow 17.

The embodiments shown in FIGS. 2 to 6 represent possibilities of the vertical adjustment of the entire accelerating and distribution bell 15.

Figure 3:
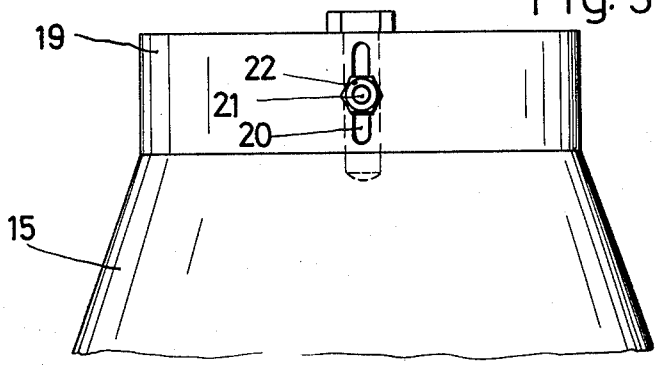
FIG. 3 is a simplified partial end view of the centrifugal in accordance with FIG. 2.
Figure 4:
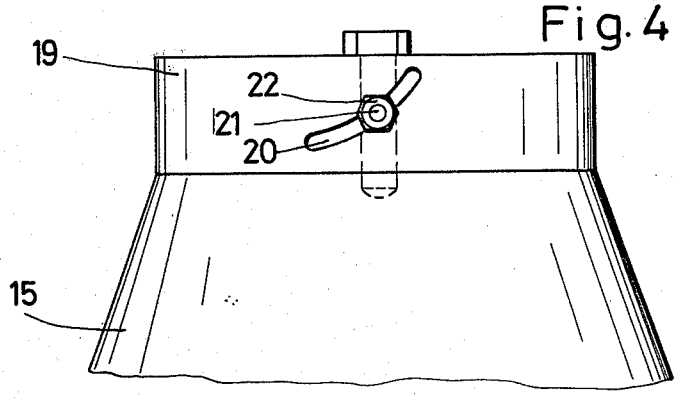
FIG. 4 shows an alternative embodiment of the centrifugal in accordance with FIGS. 2 and 3.

The examples given in FIGS. 2 to 4 refer to cases in which the liquid content of the massecuite is subject to such small variations that an adjustment of the distributing bell during operation is not necessary.

In these examples, the accelerating cup 14 inside the bell 15 is equipped with a supporting ring 18. The accelerating bell 15 is provided at its upper end with a guide sleeve or collar 19 movably and slidably mounted on the outside of the supporting ring 18.

In the simplest embodiment (FIGS. 2 and 3) the guide sleeve 19 has at least two slots 20 which extend axially and are located diametrically opposite each other. Bolts 21, preferably threaded bolts, fastened to the supporting ring 18 pass through the slots 20, whereby the bolts are movable in the slots. Thus, accelerating bell 15 can be adjusted by hand in a vertical direction as shown by the double arrow 17 and locked in the desired position by means of nuts 22 cooperating with the threaded bolts 21.

In the embodiment according to FIG. 4, the slot 20 is inclined in a circumferential direction. In this construction, the vertical adjustment is accomplished by turning guide sleeve 19 or accelerating bell 15, respectively. The locking in the selected and adjusted position is made by means of the nut 22 which is also used with slot 20 extending vertically.

Figure 5:
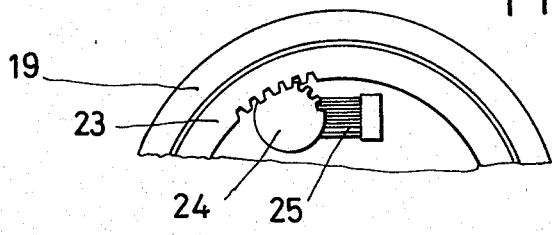
FIG. 5 shows a detail of another embodiment.

In the embodiment according to FIG. 5, the upper end of the guide sleeve 19 is provided with a ring gear 23. A gear member 24 of a motor driven control element 25 meshes with the gear ring 23. It is not important whether control element 25 is equipped with a hydraulic motor or with an electric motor. When the belt 15 is supported in an inclined slot 20 according to FIG. 4, turning of ring gear 23 and, thus, of guide sleeve 19 results in a vertical movement of the accelerating bell 15.

The embodiment according to FIG. 5 is suited for automatically controlled adjustment during operation.

It is also possible that a control element, or control elements 25 are arranged vertically if the slots 20 are extending vertically. The ring gear 23 then must be replaced by other drive elements such as a rack and pinion not shown in the drawings.

Figure 6:
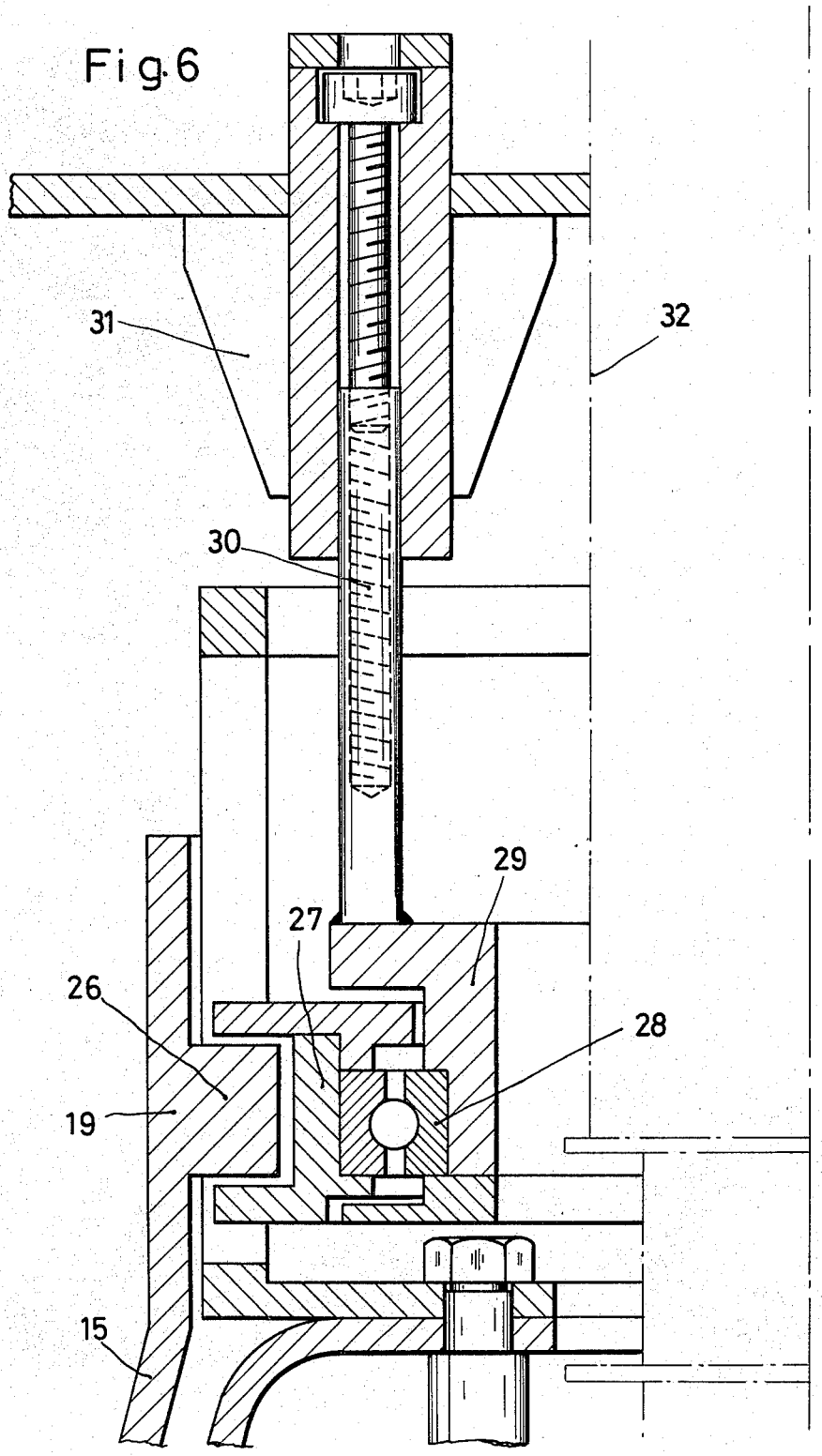
FIG. 6 shows still another embodiment for the manual, vertical distribution bell adjustment.

In the embodiment according to FIG. 6 a guide sleeve 19 is provided with a rib 26 projecting toward the inside and encircled by a ring 27. The ring 27 is fastened, by means of a ball bearing 28, to a supporting ring and threaded sleeve follower 29 which is vertically adjustable with the aid of vertically arranged adjusting screws 30. The adjusting screws 30 are held in a cross head 31 which is connected to a suitable fixed component part of the centrifugal, for example, to a massecuite inlet pipe 32 the contours of which are dash-dotted in FIG. 6. The construction of FIG. 6 allows a vertical adjustment of the accelerating bell 15 during operation of the centrifuge. However, the adjustment must be made by hand by adjusting the adjusting screws 30 which engage a threaded portion of the ring follower 29.

It is expected that in the majority of the embodiments, this manual adjustment during centrifugal operation will be sufficient for achieving a perfect syrup separation.

A fully automatic operation may be required where very large centrifuge stations are involved since, in case of massecuite modifications, too much time might pass before all centrifugals have been adjusted by hand to ensure an optimum performance.

Figure 7:
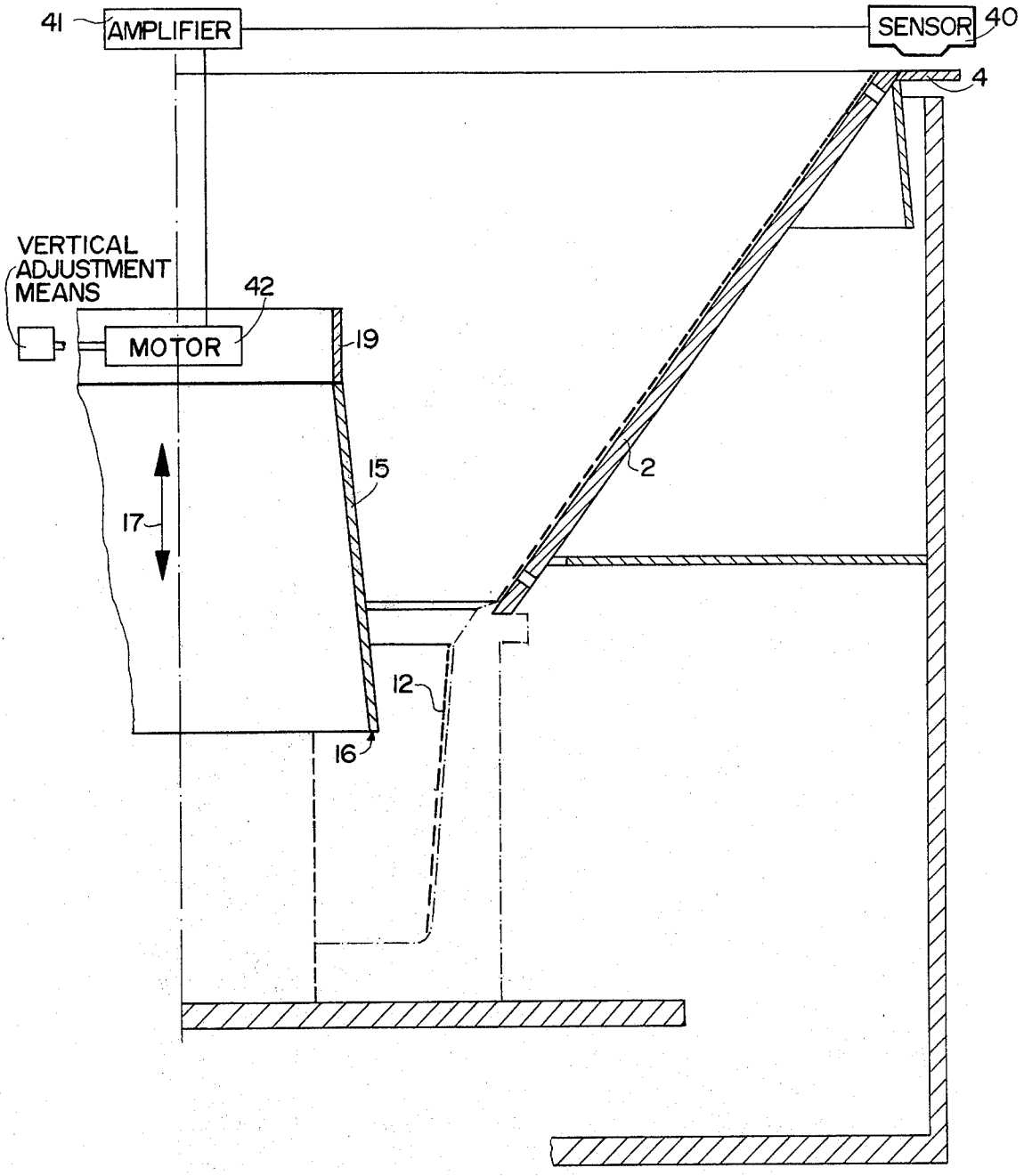
FIG. 7 is a block diagram showing a control loop with a sensor and a motor for automatically adjusting the vertical position of the distributing bell in response to the characteristics of sugar sensed at the upper output edge or rim of the centrifugal basket.

An embodiment permitting a fully automatic operation is illustrated in FIG. 7 where elements of the centrifuge appear with the reference numerals as shown in FIG. 1. In addition, a sensor 40 detects, for example, a characteristic of the separated sugar delivered to output edge 4 of centrifugal basket 2. Sensor 40 generates a signal proportional to the sensed characteristic which is amplified in an amplifier 41 and applied to control a motor 42 for raising and lowering the distributing bell 15 to achieve uniformity of output. Sensor 40 may be, for example, a photoelectric cell, measuring, for example, sugar layer thickness or the sugar quantity at the sugar output edge 4. Alternatively, a polarimeter may be used for sensor 40 to detect massecuite characteristics. The motor 42 drives vertical adjustment means as shown in some of the other figures, for example the pinion 25 in FIG. 5, or the screws 30 in FIG. 6. The screws 30 could, for example, be driven by a worm gear mechanism between the output of the motor 42 and the screws 30.

The embodiments illustrated and described represent but a few possibilities of realizing the idea of the invention, for adjusting the lower edge 16 of the accelerating bell 15 in a vertical direction in relation to an additional lower basket zone 10 equipped with a screen **12*a*, 12*b*, 12*c* of differing perforation or aperture densities and provided exclusively for the separation of considerably varying liquid contents of the massecuite in such a way that the upper zone 11** is continuously supplied with a massecuite of invariable consistency, thus ensuring an optimum utilization of its separating and throughput capacity.

Although the invention has been described with reference to specific example embodiments, it is to be appreciated, that it is intended to cover all modifications and equivalents within the scope of the appended claims.

What is claimed is:

1. A continuously operating centrifuge for separating sugar massecuite into crystalline sugar and liquid run-off comprising: centrifugal basket screening means for said separating, said centrifugal basket screening means tapering outwardly and upwardly from a lower screening basket zone (10) to an upper rim, the portion of said centrifugal basket screening means in said lower screening basket zone (10) carrying screening means in which the aperture density decreases in the upward direction, first means for mounting said centrifugal basket screening means for rotation about a generally vertical axis; accelerating cup means (14) for receiving and delivering massecuite fed to the centrifuge, second mounting means for mounting said accelerating cup means centrally within the basket screening means for rotation about said vertical axis; distributing bell means opening downwardly and located in said screening basket means to surround said accelerating cup means whereby said distributing bell means receives massecuite from said accelerating cup means, third mounting means for adjustably mounting said distributing bell means for rotation about said vertical axis to direct the massecuite from the lower edge of said distributing bell means toward the tapering basket screening means, and adjusting means for vertically adjusting the lower edge of said distributing bell means relative to said lower screening basket zone (10) of said basket screening means for distributing massecuite to different aperture density levels of the lower screening basket zone (10) according to the effective vertical position of the lower edge of said distributing bell means, whereby said massecuite may travel over relatively greater or lesser portions of the lower screening basket zone (10) according to the characteristics of the massecuites for uniform liquid removal and optimum separation of the crystalline sugar.

2. The continuously operating centrifuge of claim 1, wherein the basket screening means comprises a plurality of zones including at least an upper basket zone and said lower basket zone (10), said lower basket zone comprising apertured screen means having a frusto-conical configuration and a first slope relative to the horizontal for separating out green liquid from the massecuite and for supplying massecuite of substantially uniform consistency to said upper basket zone, said upper basket zone comprising apertured screen means of frusto-conical configuration and having a second slope less than the first slope for further centrifugal separation.

3. The centrifuge of claim 2, wherein the lower screening basket zone (10) of the basket screening means comprises aperture openings which decrease in size from the lower to upper portions of said lower screening basket zone (10), in the range of vertical adjustment of the lower end of said distributing bell, whereby said upwardly decreasing aperture density in the lower screening basket zone (10) is achieved.

4. The centrifuge of claim 3, wherein the number of apertures per unit area decreases from the lower to upper portions of the screening means.

5. The centrifuge of claim 3, wherein the lower zone of the screening means comprises three stages formed by screen elements of differing aperture density, the lower stage element having the greatest aperture density, the middle stage element having an intermediate aperture density, and the upper stage element having the least aperture density.

6. The centrifuge of claim 5, wherein the uppermost stage element substantially blocks liquid passage.

7. The centrifuge of claim 2, comprising a lower collecting compartment formed substantially around said lower apertured zone for receiving and collecting green liquid discharged from the lower zone, and an upper collecting compartment formed substantially around said upper apertured centrifugal zone for receiving and collecting white liquid discharged from the upper zone.

8. The centrifuge of claim 7, comprising separating wall means positioned between said upper and lower collecting compartments, said separating wall means being arranged at a level so that the lower apertures of the upper apertured centrifugal zone discharge into the lower collecting compartment.

9. The centrifuge of claim 1, wherein the distributing bell comprises at its upper end guide sleeve means for slidably mounting said bell, said guide sleeve means comprising slot means having a vertical component and pin means through said slot means for supporting and locking said distributing bell means at any one of a plurality of vertical positions.

10. The centrifuge of claim 9, comprising automatic control means for automatically adjusting the vertical position of said distributing bell means.

11. The centrifuge of claim 9, wherein said guide sleeve means and slot means comprise slots inclined at an angle to the vertical, whereby the vertical position of said distributing bell means may be adjusted by rotating said bell.

12. The centrifuge of claim 11, comprising automatic control means for rotating said bell.

13. The centrifuge of claim 1, comprising automatic control means (40, 41) for controlling the vertical position of said distributing bell means, said adjusting means being responsive to said control means for automatically adjusting the vertical position of the distributing bell means.

14. The centrifuge of claim 13, wherein said automatic control means comprise sensor means constructed and arranged for sensing a characteristic of sugar separated by the centrifugal basket screening means and for generating an output signal varying with said characteristic, and wherein said adjusting means comprise motor means for automatically adjusting the effective position of the lower edge of said distributing bell means, said motor means being operatively connected to the output of said sensor means and responsive to said output signal of said sensor means for vertically adjusting the lower edge of said distributing bell means according to the characteristic of the sugar.

15. The centrifuge of claim 14, wherein said sensor means comprises photoelectric cell means for measuring sugar layer thickness or quantity at the upper edge of the centrifugal basket means.

16. The centrifuge of claim 14, wherein said sensor means comprises a polarimeter.

17. The centrifuge of claim 1, wherein said means for vertically adjusting the lower edge of said distributing bell means comprises guide sleeve means operatively connected to said distributing bell means and slidably mounting said distributing bell relative to a fixed portion of the centrifuge, follower means coupled to said guide sleeve means, and adjusting screw means operatively connected to a fixed portion of the centrifuge, said adjusting screw means operatively engaging said follower means for raising and lowering the distributing bell means by turning said screw means.

18. The centrifuge of claim 1, wherein a part of said distributing bell means is also adjustable in its vertical position relative to said accelerating cup means.

* * * * *